US005910757A

United States Patent [19]

Broghammer et al.

[11] Patent Number: 5,910,757

[45] Date of Patent: Jun. 8, 1999

[54] PHASE BARRIER FOR USE IN A MULTIPHASE CIRCUIT BREAKER

[75] Inventors: William J. Broghammer; Richard W. Niccolls, both of Cedar Rapids; Darrell P. Ophaug, Marion, all of Iowa

[73] Assignee: Square D Company, Palatine, Ill.

[21] Appl. No.: 09/047,923

[22] Filed: Mar. 25, 1998

[51] Int. Cl.[6] ..... H01H 75/00

[52] U.S. Cl. ..... 335/9; 335/8; 335/10; 335/35; 335/201; 335/172

[58] Field of Search ..... 335/8–10, 35, 335/202, 201, 166, 172; 200/401, 306

[56] References Cited

U.S. PATENT DOCUMENTS

| | | | |
|---|---|---|---|
| 3,562,469 | 2/1971 | Peck | 200/169 |
| 3,748,620 | 7/1973 | Ellsworth et al. | 337/20 |
| 4,646,200 | 2/1987 | M'Sadoques et al. | 361/355 |
| 4,713,635 | 12/1987 | Flick et al. | 335/8 |
| 4,876,424 | 10/1989 | Leone et al. | 200/306 |
| 5,063,314 | 11/1991 | DeSantis | 310/71 |
| 5,193,043 | 3/1993 | Grunert et al. | 361/93 |
| 5,194,840 | 3/1993 | Frutuoso et al. | 335/202 |
| 5,241,289 | 8/1993 | Markowski et al. | 335/201 |

*Primary Examiner*—Michael L. Gellner
*Assistant Examiner*—Tuyen T. Nguyen
*Attorney, Agent, or Firm*—Larry I. Golden; Kareem M. Irfan

[57] ABSTRACT

A method and apparatus for interrupting the flow of electrical current in a multiphase circuit path between at least one source and at least one load including a circuit breaker having an electro-mechanical assembly and a blade carrier corresponding to each phase of the multiphase circuit path and a phase barrier between each blade carrier. The blade carriers are interconnected, preferably, with a crossbar wherein, when one or more phases of the circuit path are interrupted, opening one or more of the blade carriers, the crossbar moves all of the blade carriers to open positions. The phase barrier is positioned circumferentially around the crossbar between each blade carrier and includes a thermoplastic material. The electro-mechanical assembly is housed within a circuit breaker enclosure having an insulating base wall and cover wall. The phase barrier has a main body planar surface perpendicular to the blade carriers and extending from the base wall to the cover wall. The phase barrier is preferably manufactured entirely from the thermoplastic material, or in another embodiment, the phase barrier is manufactured of a fiberglass material having a thermoplastic material covering.

14 Claims, 6 Drawing Sheets

PHASE BARRIER FOR USE IN A MULTIPHASE CIRCUIT BREAKER

BACKGROUND OF THE INVENTION

1. Field of the Invention

This invention relates to the use of a barrier to eliminate arcing between phases during operation of multiphase circuit breakers.

2. Description of the Related Art

Circuit breakers are widely used in residential and industrial applications for the interruption of electrical current upon overcurrent conditions caused by short circuits or by ground faults. In a multi-phase circuit, it is common to have the contact and blade assemblies of the circuit breaker for all phases mechanically linked to each other so that the tripping of any one of any phases will cause the other phases to trip, opening the contacts of all phases. A crossbar that is attached to the circuit breaker blades or mechanisms of a multi-mechanism breaker accomplishes this linkage, providing the necessary simultaneous opening of all phase contacts.

The requirement of having sufficient space in the assembly to allow motion of the crossbar means that there is an open area in the insulation between the phases of the individual breaker. During interruption of electric current, hot ionized electrically conductive gases are produced between the contacts of the individual phases. The ionized gases from one phase may mix with the ionized gases from an adjacent phase, leading to loss of electrical insulation integrity and resulting in arcing between the phases. This kind of catastrophic failure can potentially damage the circuit breaker and the equipment that the circuit breakers are designed to protect.

Phase barriers that fit loosely over the crossbar have been used to reduce the occurrence of cross-phase arcing. Current methods use adhesive sealants to attach the barriers to the crossbar. These adhesives can melt under normal operating conditions, degrading the mechanical integrity of the barrier. In addition, whenever a breaker is tripped, small amounts of carbon and metal particles are deposited on the crossbar, increasing the risk of over-surface dielectric breakdown, necessitating the use of a sealant. The sealant and adhesives represent health risks to personnel involved in the assembly process. The sealant and adhesive emit vapors that are toxic at levels that are unacceptable under EPA and OSHA regulations. To assemble typical phase barriers requires the construction of expensive air hoods to handle the toxic vapors for the protection of manufacturing personnel.

There is a need for a phase barrier that prevents mixing of ionized gases between phases, maintains through air dielectric integrity between phases, insures over-surface dielectric integrity of a crossbar and reduces or eliminates the emission of toxic vapors. Such a phase barrier should maintain the physical integrity of the barrier under normal operating conditions.

SUMMARY OF THE INVENTION

The method and apparatus of the present invention discloses a circuit breaker for interrupting the flow of electrical current in a multiphase circuit path between at least one source and at least one load. The circuit breaker includes an electro-mechanical assembly having a blade carrier corresponding to each phase of the multiphase circuit path and a phase barrier between each blade carrier. The blade carriers are interconnected, preferably, with a crossbar wherein, when one or more phases of the circuit path are interrupted, opening one or more of the blade carriers, the crossbar moves all of the blade carriers to open positions. The phase barrier is positioned circumferentially around the crossbar between each blade carrier and includes a thermoplastic material. The electro-mechanical assembly is housed within a circuit breaker enclosure having an insulating base wall and cover wall. The phase barrier also includes a main body planar surface perpendicular to the blade carriers and extending from the base wall to the cover wall. The phase barrier is preferably manufactured entirely from a thermoplastic material, or in another embodiment, the phase barrier is manufactured of a fiberglass material having a thermoplastic material covering.

The method and apparatus of the present invention provides a phase barrier for use in a multiphase circuit breaker that eliminates mixing of ionized gases between phases, reduces the deposition of carbon and metal particles on the crossbar during circuit interruption, and reduces the emission of toxic vapors during assembly. The phase barrier of the present invention is easily assembled and securely maintains the physical and electrical integrity of the barrier under normal operating conditions while also eliminating internal cross phase when the flow of electrical current is interrupted by the circuit breaker.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1A:
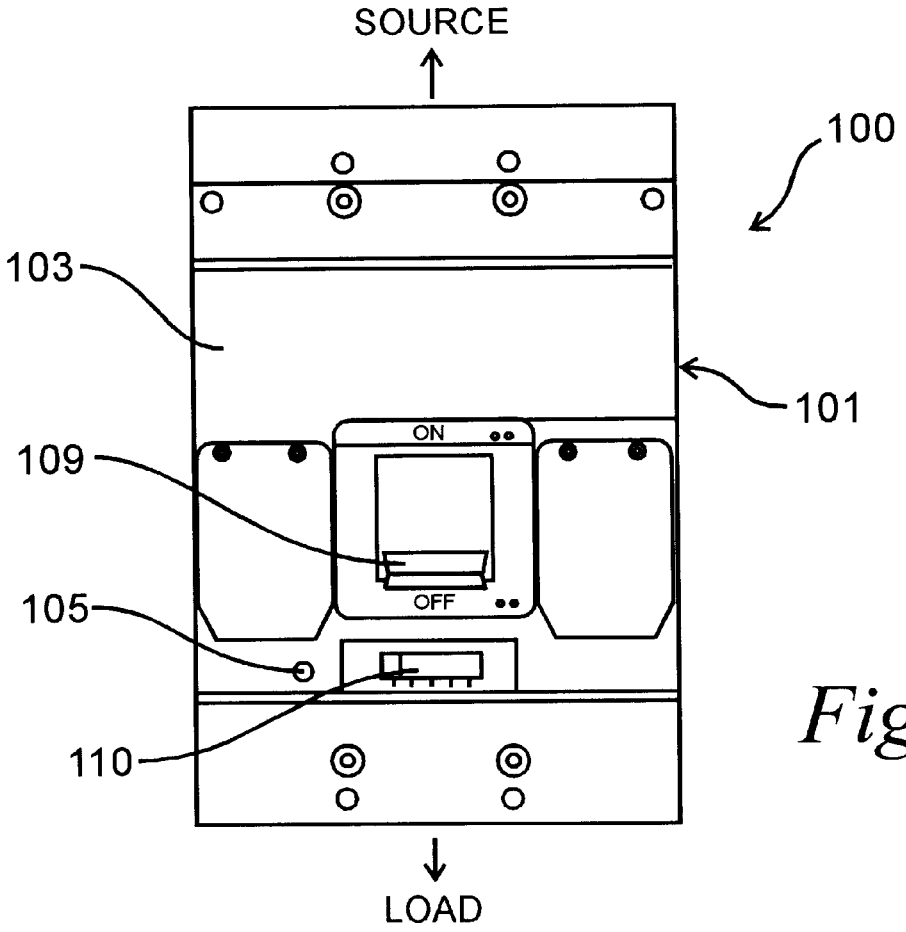
FIGS. 1A and 1B illustrate a three-phase circuit breaker according to the present invention.
Figure 1B:
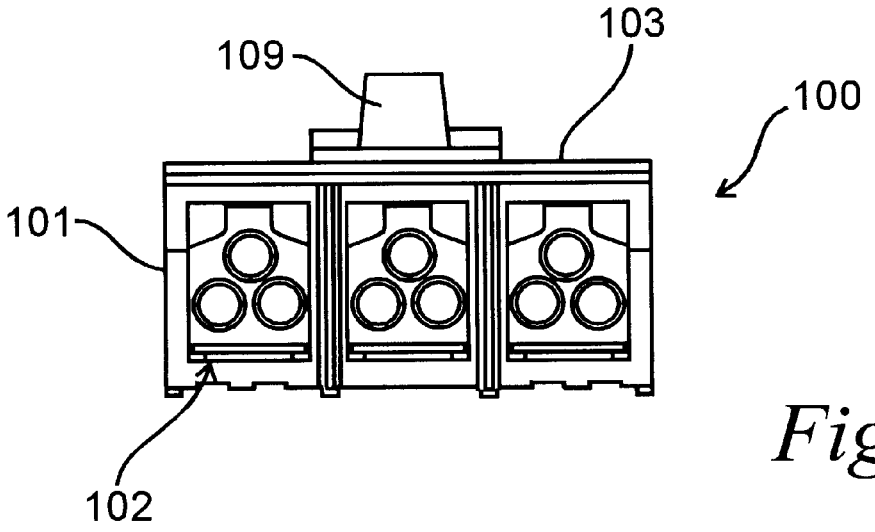

Referring to FIGS. 1A and 1B, a front view (FIG. 1A) and a bottom view (FIG. 1B) of a multiphase circuit breaker 100 according to the present invention are illustrated. The circuit breaker 100 illustrated is a three-phase circuit breaker for use with a three-phase circuit path between a source and a load. The circuit breaker 100 interrupts the flow of electrical current when a short circuit occurs in the circuit path or an overload is detected. The circuit breaker 100 includes an electro-mechanical assembly (not shown this figure) housed within a covered enclosure 101 having an insulating base wall 102 and cover wall 103. The circuit breaker 100 is tripped manually using a push to trip button 105 or, automatically, using a detection and tripping mechanism, such as magnetic trip mechanism 110. The circuit breaker 100 also includes a reset switch 109.

Figure 2:
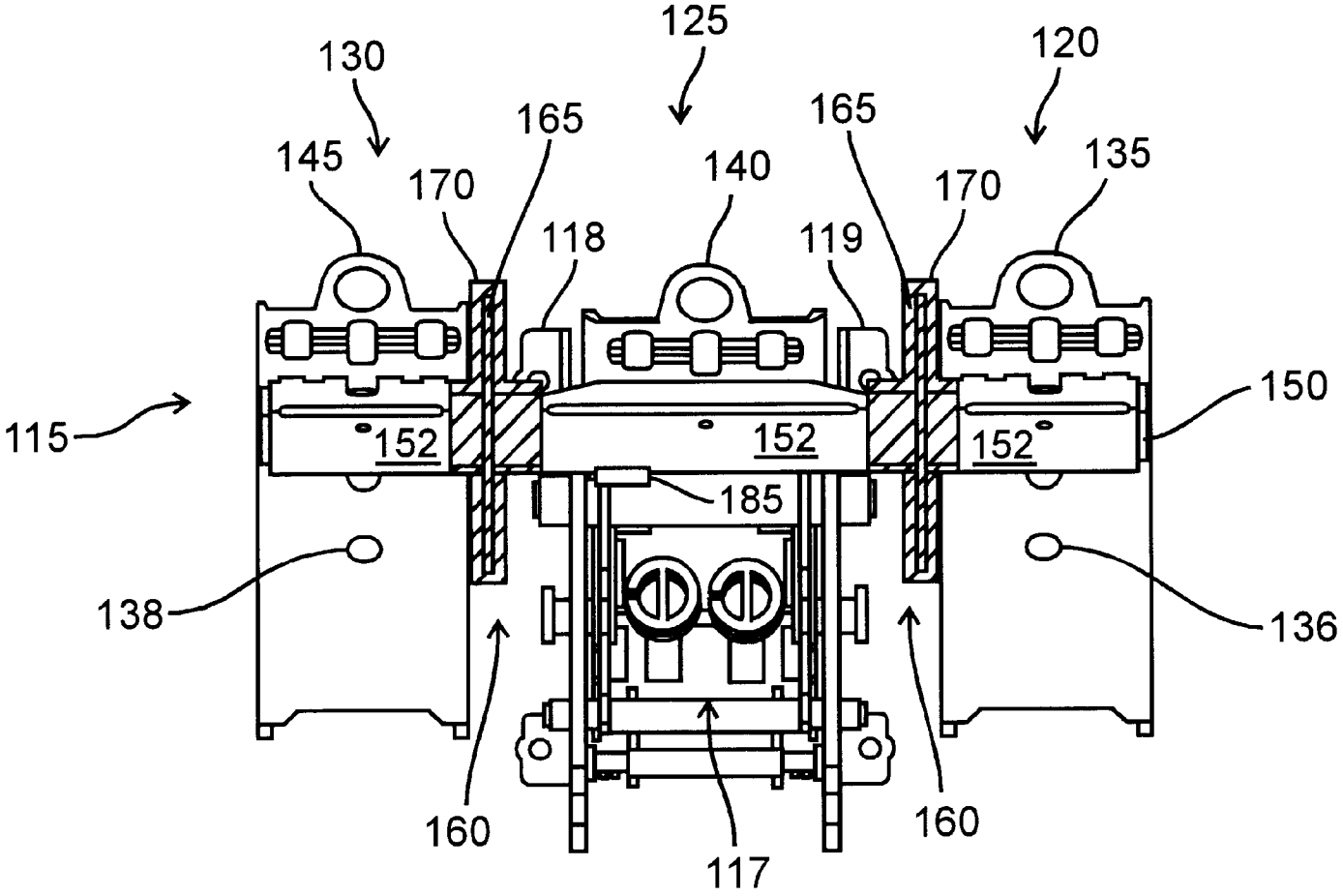
FIG. 2 illustrates the electro-mechanical assembly of the circuit breaker including a blade carrier corresponding to each phase.

FIG. 2 illustrates the uncovered electromechanical assembly 115 of the circuit breaker 100 including a section of the tripping mechanism 1 17. A left half and a right half frame assembly 118 and 119, respectively, attaches the electromechanical assembly 115 to the enclosure 101. The electromechanical assembly 115 includes a right pole 120, a center pole 125 and a left pole 130 corresponding to each phase of the multiphase circuit path. Each of the right pole 120, center pole 125 and left pole 130 includes a corresponding right blade carrier 135, center blade carrier 140 and left blade carrier 145, respectively. Each blade carrier 135, 140 and 145, respectively, controls the current path for each phase of the multiphase circuit path and has an open position and a closed position. The blade carriers 135, 140 and 145 are a part of the current path for each phase of the multiphase circuit path. The blade carriers 135, 140 and 145 may also be connected, for example, with screws through holes 136, 137 and 138, respectively, to a separate blade (not shown) as part of the current path. A phase barrier 160 is positioned between each of the right pole 120 and the center pole 125, and the center pole 125 and the left pole 130. The phase barrier 160 is described in further detail in the following figures.

Figure 3A:
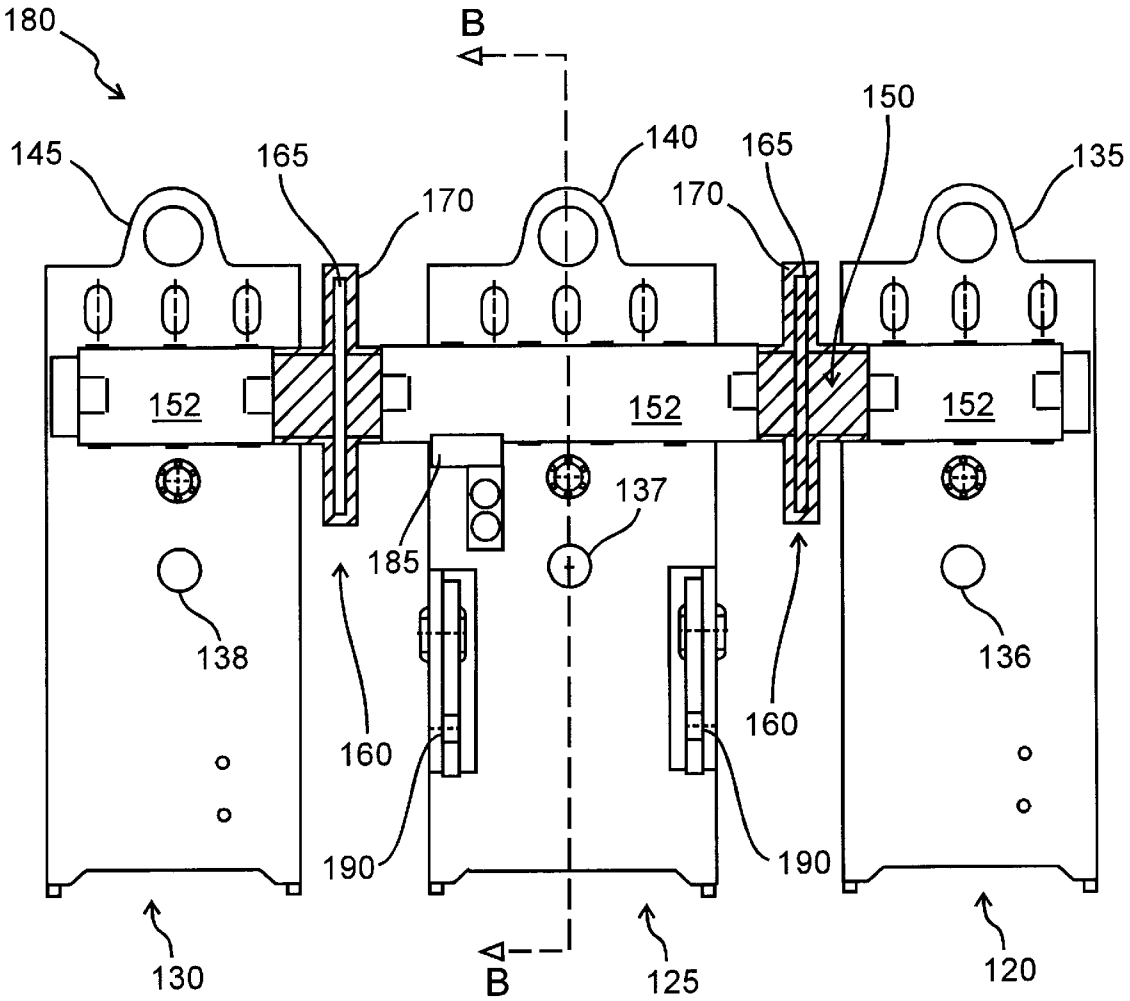
FIGS. 3A and 3B illustrate the blade carrier and crossbar assembly of the circuit breaker including the phase barrier of the present invention.
Figure 3B:
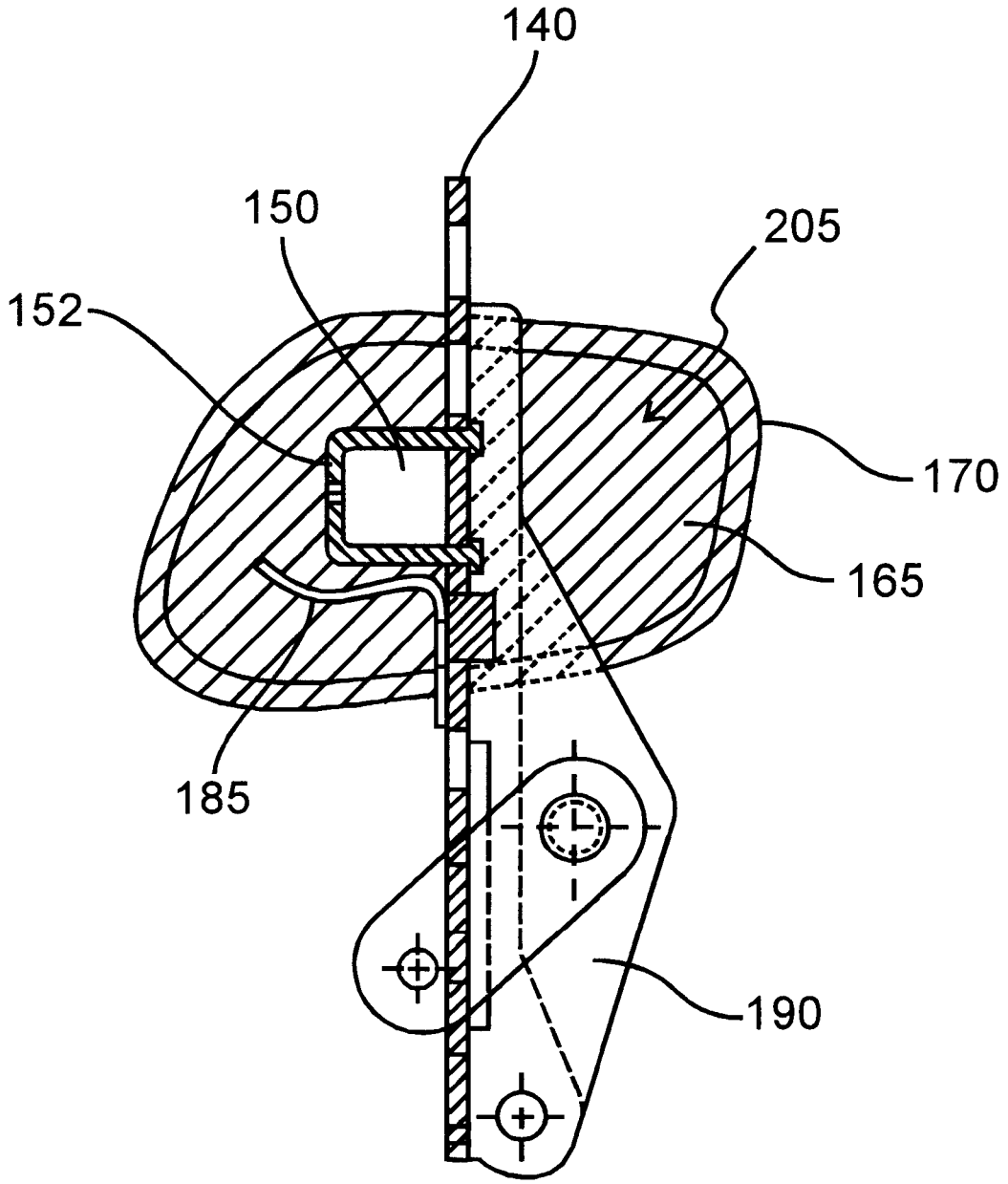

FIGS. 3A and 3B illustrate the blade carrier and crossbar assembly 180 of the circuit breaker 100 wherein FIG. 3B is a cross-sectional view of the center blade carrier 140 along line B—B of FIG. 3A. The blade carriers 135, 140 and 145, respectively, are interconnected preferably with a crossbar 150 wherein, when any one blade carrier 135, 140 or 145, respectively, is moved to an open position, all of the blade carriers 135, 140 and 145, respectively, are moved to open positions. The crossbar 150 is held in place and connected to each blade carrier 135, 140 and 145, respectively, by clamps 152 on each blade carrier 135, 140 and 145, respectively. A control mechanism 185 provides further control when moving the blade carriers 135, 140 and 145, respectively, to open and closed positions. A link assembly 190 links the center blade carrier 140 to the tripping mechanism 117. When the circuit breaker 100 is tripped, the blade carriers 135, 140 and 145, respectively, are moved to open positions and the flow of electrical current is interrupted in the circuit path.

The method and apparatus of the present invention prevents internal cross phase from occurring during interruption of the flow of electrical current by the circuit breaker 100. To operate the three poles 120, 125 and 130, respectively, of the three-phase circuit breaker 100 with a single tripping mechanism 117, the crossbar 150 must be connected to each blade carrier 135, 140 and 145, respectively, as described. An area is left opened between the poles 120, 125 and 130, respectively, to provide for insulation of the poles 120, 125 and 130, respectively. During interruption of the circuit path, arc plasma is generated. The electrically conducting arc plasma can pass between phases causing dielectric failure between the phases if not prevented. Hot ionized conductive gases can mix between the poles 120, 125 and 130, respectively, which breaks down the dielectric insulation between the poles 120, 125 and 130, respectively, and can allow an arc to initiate. An internal cross phase in a circuit breaker causes catastrophic failure and potentially damages equipment the circuit breaker is meant to protect from overloads and current spikes.

Figure 5B:
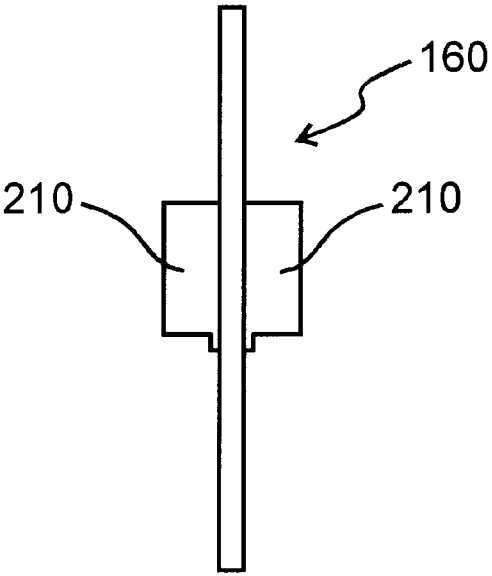
FIGS. 5A and 5B illustrate a second embodiment of the phase barrier of the multiphase circuit breaker of the present invention.

The phase barrier 160 includes an insulating material such as a thermoplastic material and is, preferably, manufactured entirely of the thermoplastic material (shown in FIGS. 5A and 5B), or as illustrated in FIGS. 3A and 3B is manufactured of a fiberglass material 165 having a thermoplastic material covering 170. The thermoplastic material is, for example, VALOX™ 771. The phase barrier 160 is positioned circumferentially around the crossbar 150 and between each adjacent blade carrier; for example, between the right blade carrier 135 and the center blade carrier 140, and the left blade carrier 145 and the center blade carrier 140. The crossbar 150 is manufactured, for instance, of a fiberglass material. The phase barrier 160 as illustrated slides over the crossbar 150 and is locked into position between the blade carriers 135, 140 and 145, respectively. However, for other style circuit breakers, the phase barrier 160 may be positioned in place using, for example, a drive screw. The phase barrier method and apparatus of the present invention reduces the amount of hot gases that mix between the poles and also cools the gas which comes in contact with the phase barrier 160.

The surface of the phase barrier 160 illustrated in FIGS. 3A and 3B, is substantially covered by the thermoplastic material 170. The thermoplastic material 170 also preferably extends over the crossbar 150 from one blade carrier to an adjacent blade carrier. The phase barrier 160 provides the necessary through air and over surface dielectric clearance to assure isolation between the phases during operation of the circuit breaker 100. The phase barrier 160 includes a main body 205 planar surface (referring to FIG. 3B and FIG. 4A) perpendicular to the blade carriers 135, 140 and 145. The main body 205 perpendicular to the blade carriers 135, 140 and 145 extends from the base wall 102 to the cover wall 103 of the enclosure 101 (shown in FIGS. 1A and 1B) further locking the phase barrier 160 in place.

The phase barrier 160 fills the space between the poles 120, 125 and 130, respectively, required for operation of the circuit breaker 100 and acts as a sealer. The phase barriers 160 move with the crossbar 150 and constantly remain between the separate blade carriers 135, 140 and 145 and poles 120, 125 and 130, respectively.

Figure 4B:
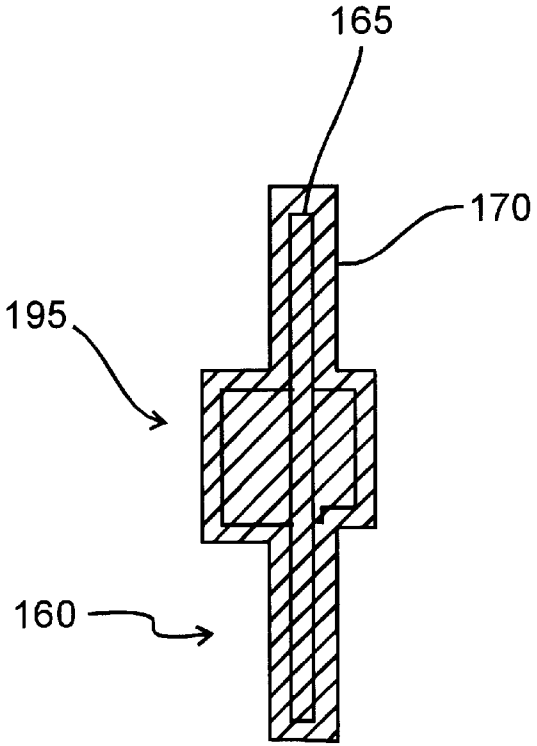
FIGS. 4A and 4B illustrate the phase barrier of the multiphase circuit breaker of the present invention.
Figure 4A:
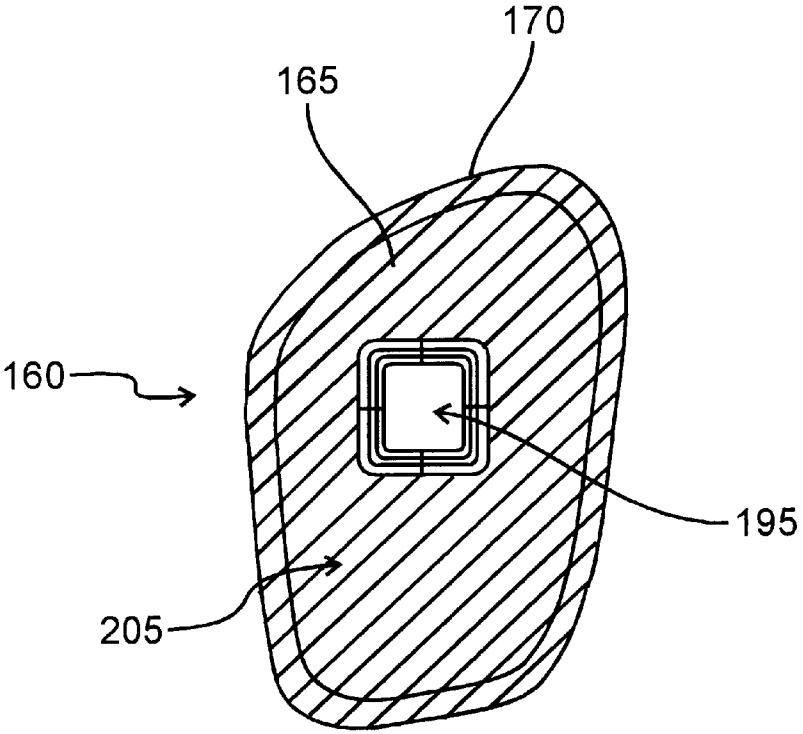

The phase barrier 160 is further illustrated in FIGS. 4A (side view) and 4B (front view) showing the phase barrier 160 having an opening 195 for fitting around the crossbar 150 and the thermoplastic material 170 covering the fiberglass material 165.

Figure 5A:
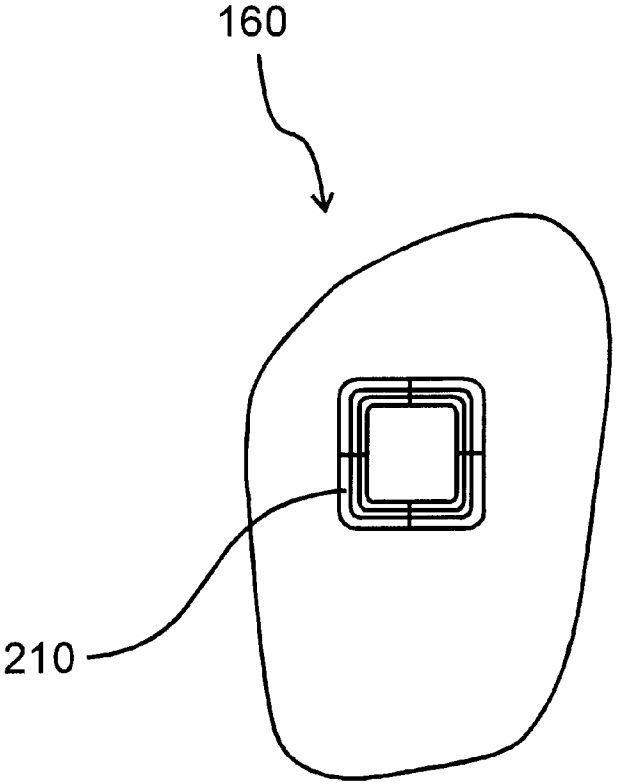

The phase barrier 160 is further illustrated in FIGS. 5A (side view) and 5B (front view) wherein the phase barrier 160 is shown manufactured entirely of the thermoplastic material and illustrating preferred symmetrical openings 210 for fitting over the crossbar 150.

The crossbar 150 is manufactured, for example, of plastic coated steel or resin-glass fiber pultrusions. These materials are selected for strength, high bending modulus, and dimensional stability; however, the materials lack the necessary electrical integrity to resist over surface dielectric failure. The phase barrier 160 of the present invention has sufficient electrical integrity to resist carbonization of the arc plasma thus protecting the crossbar 150.

The phase barrier 160 of the present invention provides a number of advantages over typically used phase barriers such as aiding in deionization of arc plasma by promoting surface and volume recombination. The mechanisms for this are the surface recombination from arc plasma electron and ion impingement and the cooling of the arc gases by endothermic ablation of the thermoplastic material 170. Additionally, the ablated materials also promote volume recombination by introducing electronegative high electron capture cross-section organic ions into the plasma thus promoting dielectric recovery after a current interruption operation. During the current interruption functioning of the circuit breaker 100, molten metal particles come from contacts, arc runners and arc stacks. These particles are carried throughout the circuit breaker 100 impinging on surfaces and freezing. A metallic coating of an insulating surface can compromise the dielectric integrity of the circuit breaker 100. The dielectric integrity of the phase barriers 160 is maintained by encapsulating or covering the molten particles and preventing a continuous metallic like surface on the phase barrier 160. The molten particles release their heat to melt the thermoplastic material 170 and the thermoplastic material 170 encapsulates the particles by solidifying around the particles.

The thermoplastic material of the phase barrier 160 provides advantages wherein the phase barrier 160 is able to handle high temperature without becoming brittle or fracturing and is able to handle quick accelerations and small impacts created, for example, by the operation of the crossbar 150. The assembly process for the circuit breaker 100 of the present invention is also simplified. The phase barrier 160 does not need to be bonded with an adhesive to the crossbar 150. The phase barrier 160 is simply slid into position on the crossbar 150 and is held in place by the mechanism components of the blade carriers 135, 140 and 145, respectively, requiring no additional assembly operations.

While preferred embodiments have been shown and described, various modifications and substitutions may be made thereto without departing from the spirit and scope of the invention. Accordingly it is to be understood that the present invention has been described by way of illustrations and not limitations.

What is claimed is:

1. A circuit breaker for interrupting a flow of electrical current in a multiphase circuit path between at least one source and at least one load, comprising:

an electro-mechanical assembly having a blade carrier corresponding to each phase of the multiphase circuit path;

a crossbar connected to each blade carrier wherein, when one or more phases of the circuit path are interrupted and a disconnection of one or more of the blade carriers occurs, the crossbar effects the disconnection of all of the blade carriers; and a phase barrier including an insulating material positioned circumferentially around the crossbar and between each blade carrier wherein the phase barrier includes a main body planar surface perpendicular to the blade carriers and wherein said insulating material further extends over the crossbar a distance from the main body planar surface between one blade carrier to an adjacent blade carrier; and wherein molten metal particles generated during interruption of said power are encapsulated by said insulating material.

2. A circuit breaker, as recited in claim 1, wherein the electro-mechanical assembly is housed within a circuit breaker enclosure having an insulating base wall and cover wall.

3. A circuit breaker, as recited in claim 2, wherein the phase barrier main body extends from the base wall to the cover wall.

4. A circuit breaker, as recited in claim 1, wherein the phase barrier is manufactured entirely of a thermoplastic material.

5. A circuit breaker, as recited in claim 1, wherein the phase barrier is manufactured of a fiberglass material having a thermoplastic material covering.

6. A method for interrupting a flow of electric current in a multiphase circuit path between at least one source and at least one load, the method comprising:

connecting an electro-mechanical assembly between said at least one source and said at least one load, the electro-mechanical assembly having a blade carrier corresponding to each phase of the multiphase circuit path, each blade carrier used as a switch and having an open position and a closed position;

interconnecting the blade carriers using a crossbar wherein, when one blade carrier is moved to an open position, all of the blade carriers are moved to open positions;

positioning a phase barrier around the crossbar and between each blade carrier wherein the phase barrier includes a main body planar surface perpendicular to the blade carriers and an opening for sliding the phase barrier into position on the crossbar, the phase barrier including an insulating material and wherein said insulating material further extends over the crossbar a distance from the main body planar surface between one blade carrier to an adjacent blade carrier; and tripping the circuit breaker wherein the blade carriers are moved to open positions and the flow of electrical current is interrupted; and wherein molten metal particles generated during interruption of said flow of electrical current are encapsulated by said insulating material.

7. A method, as recited in claim 6, wherein the phase barrier is manufactured entirely of a thermoplastic material.

8. A method, as recited in claim 6, wherein the phase barrier is manufactured of a fiberglass material having a thermoplastic material covering.

9. A method, as recited in claim 6, further comprising:

generating molten metal particles in the electro-mechanical assembly during interruption of the flow of electrical current; and encapsulating the molten metal particles in the thermoplastic material.

10. A phase barrier for use in a multiphase circuit breaker connected to a multiphase circuit path, the circuit breaker including an electro-mechanical assembly having a blade carrier corresponding to each phase and wherein each blade carrier is used as a switch in the multiphase circuit path, the phase barrier comprising:

a main body planar surface perpendicular to the blade carriers;

an opening for sliding the phase barrier into position on a crossbar connected to each blade carrier; and wherein the phase barrier is positioned circumferentially around the crossbar and between each blade carrier, the phase barrier including a thermoplastic material; and wherein the thermoplastic material further extends over the crossbar a distance from the main body planar surface between one blade carrier to an adjacent blade carrier.

11. A phase barrier, as recited in claim 10, wherein the electromechanical assembly is housed within a circuit breaker enclosure having an insulating base wall and cover wall.

12. A phase barrier, as recited in claim 11, wherein the phase barrier main body extends from the base wall to the cover wall.

13. A phase barrier, as recited in claim 10, wherein the phase barrier is manufactured entirely of a thermoplastic material.

14. A phase barrier, as recited in claim 10, wherein the phase barrier is manufactured of a fiberglass material having a thermoplastic material covering.

* * * * *